US005224810A

United States Patent [19]

Pitkin

[11] Patent Number: 5,224,810

[45] Date of Patent: Jul. 6, 1993

[54] ATHLETIC SHOE

[76] Inventor: Mark R. Pitkin, 22 Pond St., Apt. 7, Sharon, Mass. 02067

[21] Appl. No.: 715,814

[22] Filed: Jun. 13, 1991

[51] Int. Cl.[5] ..... A43B 13/12

[52] U.S. Cl. ..... 36/30 R; 36/25 R

[58] Field of Search ..... 36/30 R, 31, 1, 25 R, 36/116, 28, 29

[56] References Cited

U.S. PATENT DOCUMENTS

| | | | |
|---|---|---|---|
| 3,824,716 | 7/1974 | DiPaolo | 36/30 R |
| 3,834,046 | 9/1974 | Fowler | 36/30 R |
| 4,364,189 | 12/1982 | Bates | 36/31 |
| 4,457,084 | 7/1984 | Horibata et al. | 36/7.8 |
| 4,547,979 | 10/1985 | Harada et al. | 36/31 |
| 4,798,010 | 1/1989 | Sugiyama | 36/31 |
| 4,864,737 | 9/1989 | Marrello | 36/29 |
| 4,890,397 | 1/1990 | Harada et al. | 36/30 R |

FOREIGN PATENT DOCUMENTS

| | | | |
|---|---|---|---|
| 4849 | of 1899 | United Kingdom | 36/7.8 |
| 466357 | 5/1937 | United Kingdom | 36/7.8 |

*Primary Examiner*—Steven N. Meyers

*Attorney, Agent, or Firm*—Weingarten, Schurgin, Gagnebin & Hayes

[57] ABSTRACT

An athletic shoe to provide a safe orientation of the foot during an immediate stop in the medial lateral direction and to preclude hyperinversion of the foot in the subtalar joint is shown. The shoe sole has an upper sole member and a lower sole member which are elastically connected by a resilient member along the lateral and medial edges of the shoe. The upper and lower sole members are each wedge-shaped and disposed in opposite orientation in sliding engagement along confronting concave-convex surfaces having corresponding curvatures. The upper and lower sole members may include medial to lateral extending ribs. A lubricant may be provided between the confronting surfaces and the ribs.

10 Claims, 3 Drawing Sheets

ATHLETIC SHOE

BACKGROUND OF THE INVENTION

The present invention relates to the field of athletic shoes, and, in particular, to a design made to reduce the risk of injury to the subtalar joint when an athlete in motion comes to a sudden stop.

Said injury occurs when the ankle moves from neutral (see FIG. 1,*a*) to the inverted (see FIG. 1,*b*) position and the bending torque of the external forces becomes more than the counter-resistance of the joint's ligaments.

Due to the abrupt stop, the ground reaction is applied to the lateral edge of the shoe sole. A force due to friction between the ground and the shoe (the horizontal component of said ground reaction) acts on the bottom surface of the sole in medial direction. Because the foot is placed in the shoe comparatively tightly, that action of the force of friction is transferred by the shoe to the lateral edge of the foot.

Said force of fiction provides a bending torque relative to the subtalar joint. On the other hand, the weight of the athlete's body applied to the center of mass acts vertically downward and provides an oppositely directed torque relative to the same joint. The greater the negative acceleration of the stop, the greater are the magnitudes of said controversial or oppositely directed torques, and the more probable the injury is.

To prevent said injuries, U.S. Pat. No. 3,664,040 shows a sole element having an edge band of thermoplastic material in lieu of a textile or other tape. It resists slightly, to the sliding of the foot relative to the shoe, but does not bind the foot when the body of the wearer is moving at comparatively high speed before emergency stopping.

To separate the influence of the upper and bottom surfaces of the shoe sole, U.S. Pat. No. 4,635,384 suggests a sole comprising an upper and a lower sole, communicating through the air pockets, but it does not remove a cause of a dangerous inversion, namely, decreasing of the thickness of the lateral edge of a sole during emergency stopping.

Said process is illustrated by FIG. 2, where F1 is force acting from the foot on the upper surface of the sole and on the medial shoe's quarter, and F2 is the force of friction applied from the ground to the bottom surface of the sole. Said two forces create a pair, whose action is equivalent to the torque M rotating the sole clockwise and pressing the upper lateral edge of the sole to the ground.

Moreover, when the magnitude of the torque M exceeds a certain value, it starts to rotate the sole (and the rest of the shoe with the foot inside) relative to the bottom lateral edge. It leads directly to the injury of the subtalar joint.

Implementation of the "wedge" idea can be seen in an embodiment of the U.S. Pat. No. 4,934,073, wherein a reverse wedge is shown, which lifts the ball of the wearer's foot. Since that wedge is mounted permanently and is made from resilient and flexible material, during emergency stopping it should be affected by the toque similar to M, described above, which would decrease its useful thickness. On the other hand, said wedge is placed in the sagittal plane and almost does not influence the frontal displacements of the foot.

Summarizing the existing approaches, we can see so-called "negative feedback" everywhere: the more the value of the dangerous torque M is, the worse is the capability of the athletic shoe to prevent the injury of the subtalar joint.

SUMMARY OF THE INVENTION

In view of the foregoing, it is an object of the present invention to design an athletic shoe, which provides increasing of the shoe's capability to prevent injury of the subtalar joint, when the force of ground reaction increases (the dangerous torque M increases).

It is a further object of the present invention to enhance the level of performance of the shoe's wearer by means of giving him/her a feeling of confidence in their safety.

These objects are achieved in accordance with preferred embodiments of the present invention by including in an otherwise conventionally designed athletic shoe an upper sole, connected with shoe's upper, and a lower sole. At the same time, both soles are elastically connected each with the other for the purpose of a controlled relative shift in the frontal plane, and have the shape of two controversial or oppositely directed wedges in the frontal cross section.

In accordance with a modified embodiment of the present invention, when the negative acceleration of stopping becomes more than a certain value, the upper sole (together with the upper of the shoe and the wearer's foot in it) starts to shift in the lateral direction, activating the means for elastic return of the upper sole to the initial position after releasing of the shifting pair of forces from the foot and from the ground.

In accordance with a modified embodiment of the present invention, a shift of the upper sole in the lateral direction during an emergency stopping provides the lifting of the lateral upper edge of said sole, and its medial upper edge goes down. It changes the initial horizontal orientation of the foot, namely: the lateral edge of the foot goes up, since the upper surface of the upper sole inclines and forms in the frontal plane a temporary wedge for the foot, with the thickness of said wedge increasing laterally.

These and further objects, features and advantages of the present invention will become more obvious from the following description when taken in connection with the drawings which allow, for the purpose of illustration only, several embodiments with the present invention.

DETAILED DESCRIPTION OF THE PREFERRED EMBODIMENTS

Figure 3:
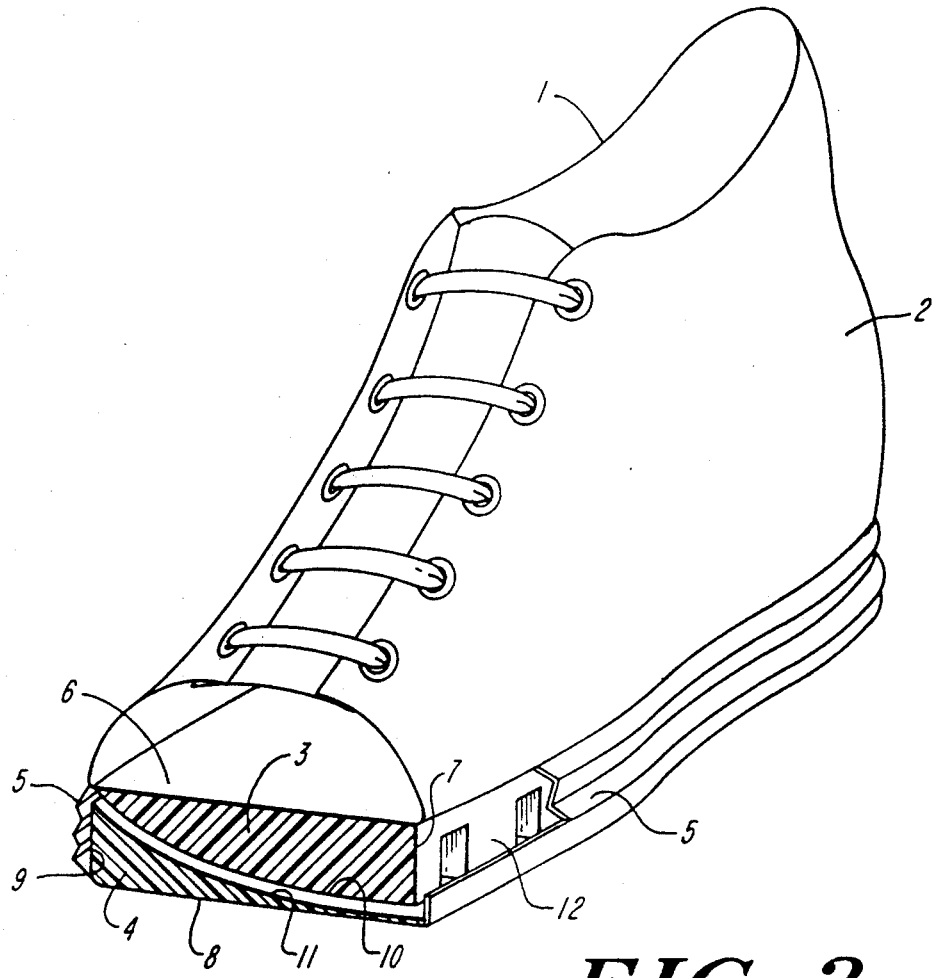
FIG. 3 is a 3-D view, partly in cross section, illustrating a conventional upper of an athletic shoe attached to the combined sole of the present invention illustrating two soles with the shape of two controversial or oppositely directed curved wedges in the frontal cross section (front view of the right shoe).

With reference to FIG. 3, wherein an athletic shoe 1, having a standard shoe's upper 2, is provided with upper sole 3, lower sole 4, and interconnecting means 5 for returning of said soles into initial position after releasing forces, affecting their shift during an emergency stopping in medial direction.

To the extent described so far, this athletic shoe design is conventional in every respect.

On the other hand, in a departure from the prior art, as can be seen from FIGS. 3 through 6 upper 2 of the shoe is mounted on the upper sole 3, having in lateral-medial (front) cross section the shape of a curved triangle or wedge with a horizontal upper side 6. The length of the smallest side 7 of said triangle equals almost the thickness of the combined sole of the said shoe, and placed under the medial edge of the wearer's foot. The lower sole 4 has the shape of the controversial or oppositely directed triangular wedge of which the horizontal side corresponds to the bottom surface 8 of the combined sole, and the smallest side 9 is placed under the lateral edge of the foot.

Both of the triangles of the upper and lower soles slidingly contact each the other along their third sides 10 and 11 respectively, having the same correspondent curvature. Ribs 12 extending from the medial to lateral sides of the upper and lower soles provide easy bending of said shoe during performance and limit a relative shift of said soles in the sagittal direction. A lubricant 13 is preferably provided in the space between the ribs and between the surfaces 10 and 11.

Figure 1:
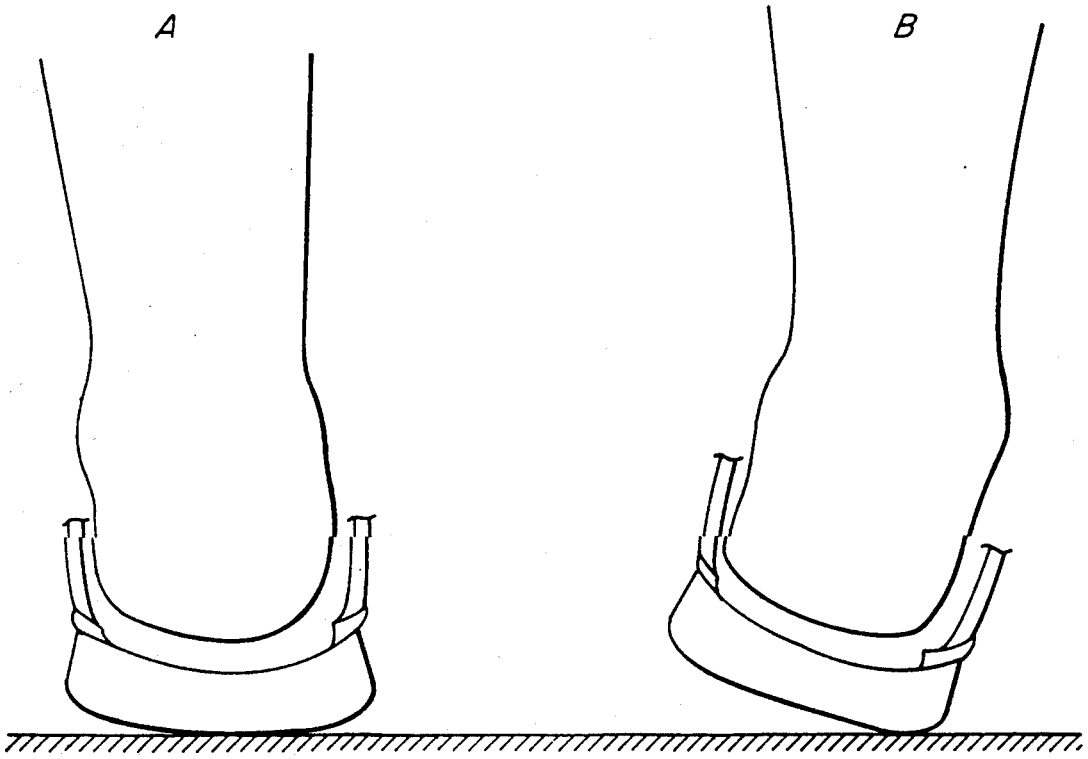
FIG. 1 is a schematic illustration of a foot in a neutral position and of the inversion of the foot in the subtalar joint during an emergency stopping (rear view of the right foot).
Figure 2:
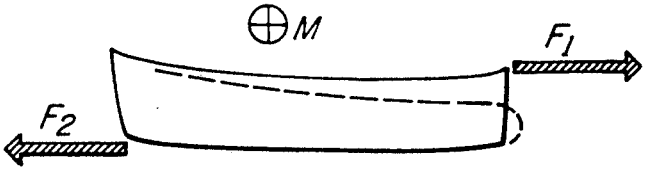
FIG. 2 is a schematic illustration depicting the forces applied to the sole during an emergency stopping (rear view of the right shoe's sole).
Figure 4:
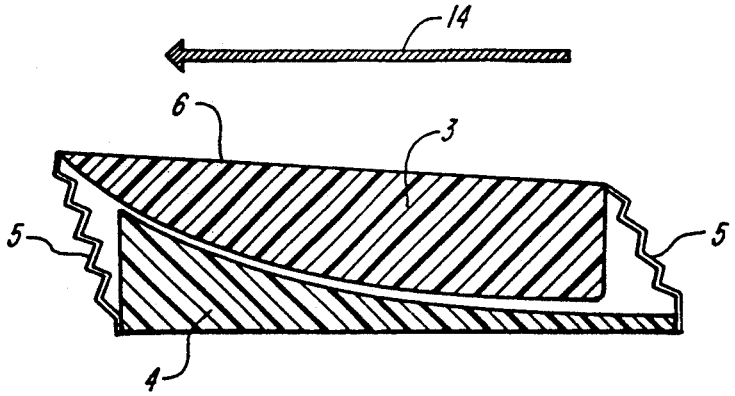
FIG. 4 is a frontal cross sectional view of said soles of the right shoe in a position, illustrating the change of the orientation of the upper surface of the upper sole in process of an emergency stopping.
Figure 5:
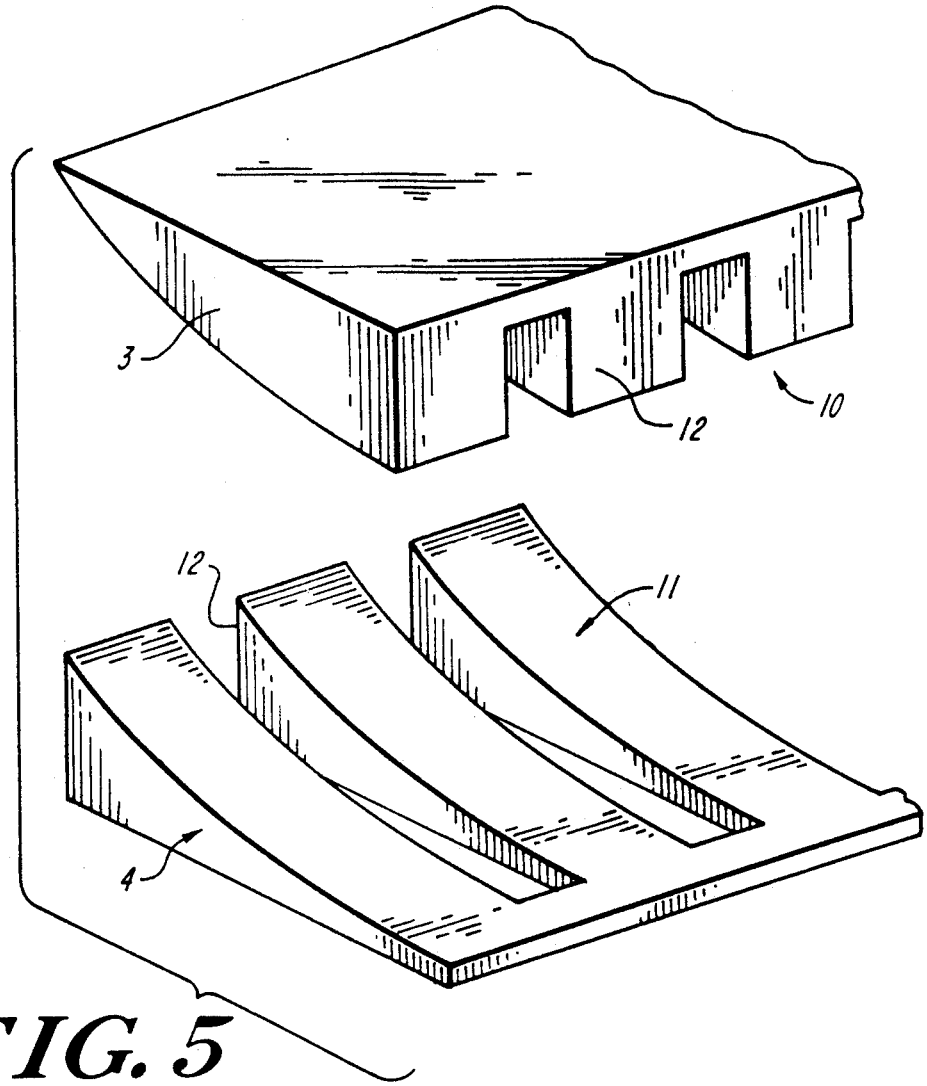
FIG. 5 is an exploded perspective view of the upper and lower soles illustrating a rib-like structure.
Figure 6:
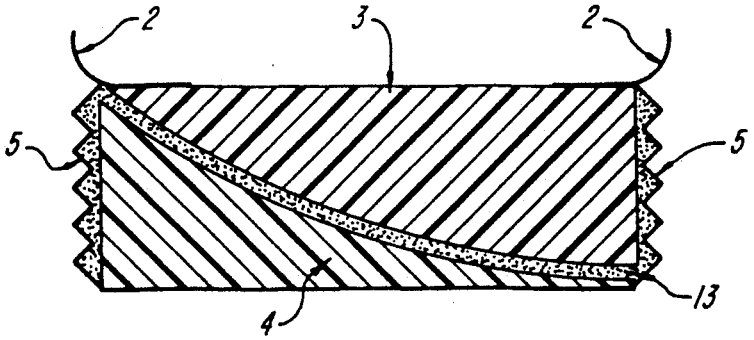
FIG. 6 is a frontal cross section al view of the sole of FIG. 3.

FIG. 4 corresponds to the shifted position of the said soles 3, 4 under the effect of the forces,, F1 and F2, indicated in FIG. 2, and the activated interconnecting means 5. The direction of lateral shift of the upper sole is indicated by arrow 14 on FIG. 4. It can be seen that both effects take place: absolute lifting of the lateral upper edge and relative going down of the medial edge of the said upper sole 3.

We can note here at least three mechanical advantages of said result. 1) Forming of the temporary wedge inclined medialy changes a correlation between the components of the ground reaction applied through the shoe to the foot: its horizontal component decreases in benefits to the vertical component. 2) The two-sole system with a means for elastic return of said system to the initial position tends to increase the stopping time, and consequently, less potentially destructive forces are applied to the foot and ankle.

3) Lifting of the foot during stopping takes a certain amount of the kinetic energy which should be converted into the heat and energy of deformation of the shoe and the wearer's muscle-skeletal system.

While I have shown and described some embodiments in accordance with the present invention, it is understood that the same is not limited thereto, but is susceptible to numerous changes and modifications as known to those skilled in the art, and I, therefore do not wish to be limited to the details shown and described herein, but intend to cover all such changes and modifications as are encompassed by the scope of the appended claims.

I claim:

1. An athletic shoe sole for an athletic shoe, comprising:
   - a generally wedge shaped upper sole member comprising:
     - a medial edge,
     - a lateral edge thinner than said medial edge,
     - a top surface, and
     - a lower surface convexly curved from said lateral edge to said medial edge;
   - a generally wedge shaped lower sole member disposed in sliding engagement with said upper sole member, said lower sole member comprising:
     - a medial edge,
     - a lateral edge thicker than said medial edge,
     - a bottom surface, and
     - a upper surface concavely curved from said medial edge to said lateral edge and disposed in slidable confronting engagement with said convexly curved lower surface of said upper sole member, the concave curvature of said upper surface corresponding to the convex curvature of said lower surface of said upper sole; and
   - a resilient, elastomeric peripheral member circumferentially interconnecting said upper sole member and said lower sole member along said medial and lateral edges.

2. The athletic shoe sole of claim 1, further comprising a lubricant between said confronting upper and lower curved surfaces.

3. The athletic shoe sole of claim 1, wherein said upper sole member and said lower sole member each include a plurality of spaced, medial-to-lateral extending ribs, each rib of said upper sole member in confronting alignment with an associated rib of said lower sole member.

4. The athletic shoe sole of claim 3, further comprising a lubricant between said ribs and said confronting upper and lower surfaces.

5. An athletic shoe comprising:
   - a sole comprising a generally wedge shaped upper sole member having a thicker medial edge, a generally wedge shaped lower sole member having a thicker lateral edge, said upper sole member and said lower sole member being oppositely oriented and disposed in a medial to lateral sliding confronting engagement along abutting surfaces, and a resilient, elastomeric peripheral member circumferentially interconnecting said upper sole member and said lower sole member; and
   - an upper attached to said upper sole member..

6. The athletic shoe of claim 5, wherein said abutting surfaces are correspondingly curved.

7. The athletic shoe of claim 6, wherein said abutting surface of said upper sole member is convexly curved from said medial edge to said lateral edge and said abutting surface of said lower sole member is concavely curved from said medial edge to said lateral edge.

8. The athletic shoe of claim 5, further comprising a lubricant between said abutting surfaces.

9. The athletic shoe of claim 5, wherein said upper sole member and said lower sole member each further include a plurality of spaced, medial-to-lateral extending ribs, each rib of said upper sole member in confronting alignment with an associated rib of said lower sole member.

10. The athletic shoe of claim 9, further comprising a lubricant between said ribs and said abutting surfaces.

* * * * *

UNITED STATES PATENT AND TRADEMARK OFFICE

CERTIFICATE OF CORRECTION

PATENT NO. : 5,224,810

DATED : July 6, 1993

INVENTOR(S) : Mark R. Pitkin

It is certified that error appears in the above-indentified patent and that said Letters Patent is hereby corrected as shown below:

Column 3, line 3, "section al" should read --sectional--.

Column 3, line 39, "forces,," should read --forces--.

Signed and Sealed this

Second Day of August, 1994

*Attest:*

BRUCE LEHMAN

*Attesting Officer*

*Commissioner of Patents and Trademarks*